United States Patent [19]

Heidmann et al.

[11] 4,402,271

[45] Sep. 6, 1983

[54] ANTI-TANK MINE WITH WIDE SURFACE OF ACTION

[75] Inventors: Richard Heidmann; Jean Poisson, both of Vernon, France

[73] Assignee: Societe Europeenne De Propulsion, Puteaux, France

[21] Appl. No.: 243,429

[22] Filed: Mar. 13, 1981

[30] Foreign Application Priority Data

Mar. 20, 1980 [FR] France ..... 80 06248

[51] Int. Cl.[3] ..... F42B 23/04

[52] U.S. Cl. ..... 102/362; 102/401; 102/424

[58] Field of Search ..... 102/362, 374, 377, 378, 102/386, 387, 388, 397, 401, 424, 427, 428

[56] References Cited

U.S. PATENT DOCUMENTS

| | | | |
|---|---|---|---|
| 1,077,991 | 11/1913 | Maxim | 102/397 |
| 2,330,205 | 9/1943 | Cox | 102/427 |
| 3,304,864 | 2/1967 | Thomanek | 102/427 |
| 3,498,219 | 3/1970 | Axelson | 102/8 |

FOREIGN PATENT DOCUMENTS

| | | | |
|---|---|---|---|
| 502598 | 5/1920 | France . | |
| 815386 | 7/1937 | France | 102/424 |
| 816616 | 8/1937 | France | 102/401 |
| 1133064 | 3/1957 | France . | |
| 1469756 | 2/1967 | France . | |
| 561665 | 5/1944 | United Kingdom | 102/427 |

*Primary Examiner*—Charles T. Jordan

*Attorney, Agent, or Firm*—Schwartz, Jeffery, Schwaab, Mack, Blumenthal & Koch

[57] ABSTRACT

An anti-tank mine with a wide area of action comprising means for detecting a target of the tracked-vehicle type and a mine body incorporating a pyrotechnic charge, means for controlling the triggering of the mine in response to a signal given by the target detection means, means for firing the charge and means for propelling the mine body triggered by the control means. The target detection means are associated with reinforcement means to constitute at least one flexible guide-detection cable serving as a guide when the mine body moves under the action of the propelling means in response to the detection of a target. Preferably a plurality of guide-detection cables spreadable in several different directions around the mine body are used.

11 Claims, 13 Drawing Figures

11
1
1
11
103
1
100
111
1
104
101
111
109
105
112
111
106
107
102
170
1
171
10
1
108

Fig. 7a
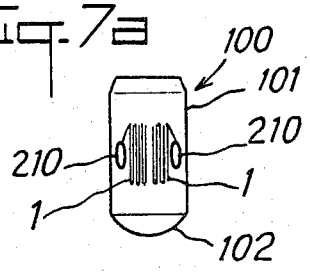
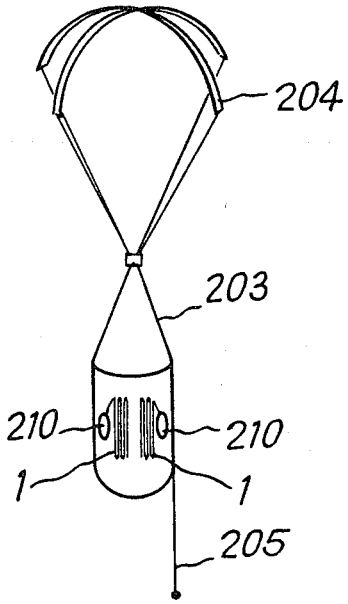
Fig. 7b
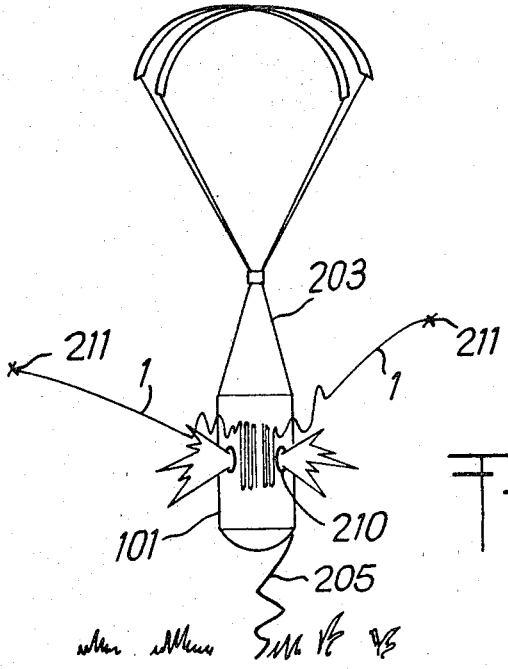
Fig. 7c
Fig. 7d
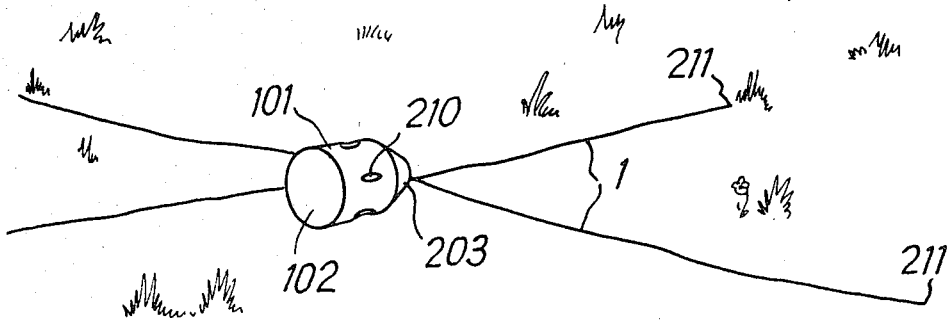

ANTI-TANK MINE WITH WIDE SURFACE OF ACTION

The present invention relates to an anti-tank mine with a wide area of action, comprising means for detecting a target of the tracked-vehicle type and a mine body incorporating a pyrotechnical charge, means for controlling the triggering of the mine in response to a signal given by the said target detection means, means for firing the charge and means for propelling the mine body triggered by the said control means.

Different types of anti-tank mines are known which are laid on the grounds in the area to be mined, or which are dropped from a missile or a rocket. Such mines explode when a target detection system situated in the vicinity of the mine has detected the presence of a possible target. The detection means can be very varied, such as of the seismic or infra-red pick-up types, or a $CO_2$ detection or resistor type system. However, the range of the mine which stays in a fixed position remains limited and a large amount of ammunitions is needed in order to mine an area with enough density to guarantee sufficient damage.

It is precisely the object of the invention to propose anti-tank mines with increase range, which are easy to lay.

These objects are reached with a mine of the type defined hereinabove which, according to the present invention, comprises at least one flexible guide-detecting cable provided with both target detection and reinforcement means to constitute a guide when the mine body moves under the action of the said propelling means.

Preferably the mine comprises a plurality of guide-detection cables spreadable in several different directions around the mine body, and means for selecting the active cable which are controlled by the said control means after the delivery of a signal by one of the cables to disconnect from the mine body all the other cables.

The means for propelling the mine body can comprise a small jet-propeller placed inside the mine body.

According to one embodiment of the invention, a disconnectable base with auxiliary propelling means is associated to the mine body, the cable ends closest to the mine body are joined to the said disconnectable base, the mine body is slidable with respect to the cables and the auxiliary means for propelling the disconnectable base and the mine body propelling means are triggered virtually simultaneously after the detection of a target.

The free ends of the cables which are farthest from the mine body in the position where the cables are spread out are advantageously provided with anchorage-to-the-ground means.

According to a special feature of the invention, the mine body comprises a front casing member of essentially conical or ogival shape and the pyrotechnical charge is situated behind the said casing member.

According to a variant embodiment, applicable for example to the case of drop-mines, the mine comprises an automatic unfolding system for the guide-detection cables previously coiled on the mine body, and said unfolding system comprises fly-weights attached to the free ends of the cables to be projected away from the mine body, and means for ejecting the fly-weights away from the mine body when the mine is laid.

In the case of drop-mines, the mine is preferably equipped with a system for stabilizing it in the vertical position and for slowing down the dropping speed of the mine if necessary.

The mine can also be provided with means for detecting the proximity of the ground, in which case the system ensuring the automatic unfolding of the guide-detection cables is controlled by the said means for detecting the proximity of the ground.

The mine can comprise an unfoldable front casing member the unfolding of which is controlled by the mine body stabilizing system.

According to yet another embodiment of the invention, the mine comprises means for winding up the guide-detection cable incorporated in the mine body and the mine body propelling means comprise a gas generator for supplying the means which drive the cable winding means in rotation, when the said mine body starts moving under the action of the control means after the detection of a target, so as to drive the mine body towards the free end of the active guide-detection cable.

The invention will be more readily understood on reading the following description with reference to the accompanying drawings, in which:

FIGS. 1*a* to 1*c* schematically illustrate three stages of operation of an example of mine according to the invention;

FIG. 2 is an axial cross-section of a layable mine according to the invention along line II—II of FIG. 3, which

Figure 8:
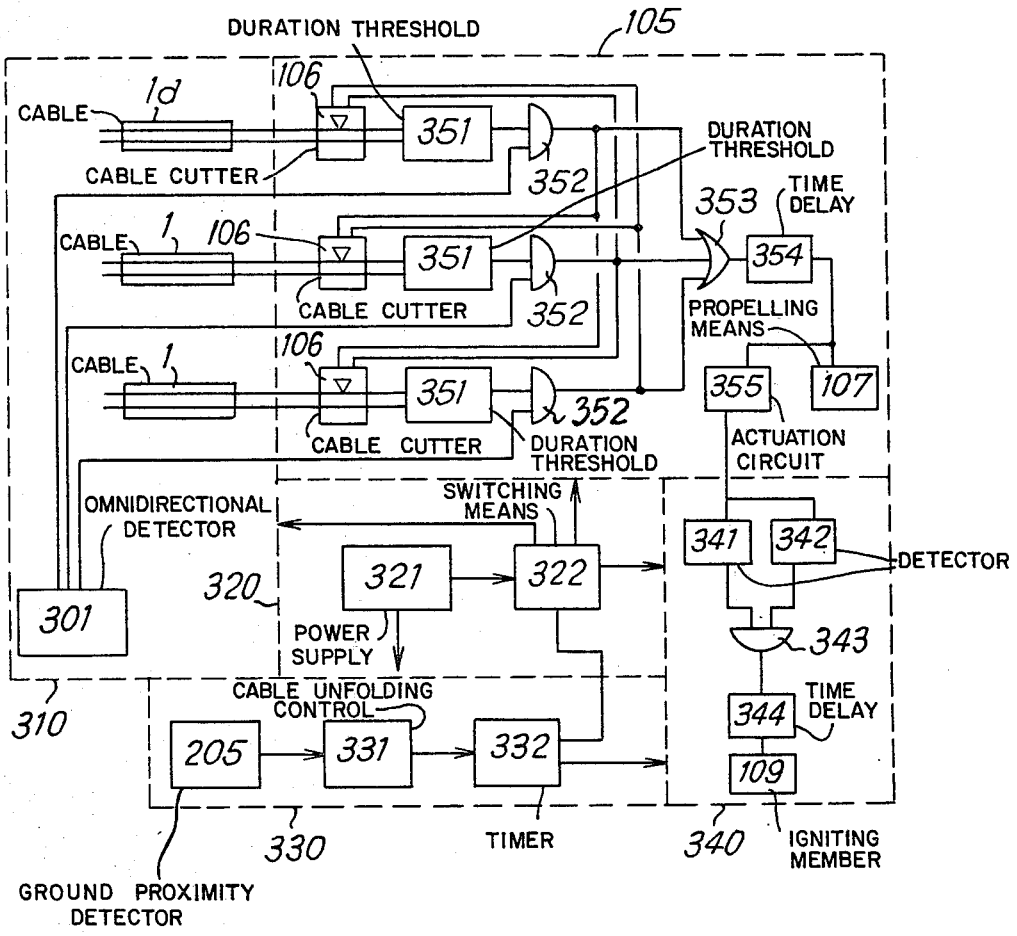

FIGS. 7*a* to 7*d* schematically illustrate four steps in the positioning of a drop-mine according to the invention, and FIG. 8 is a block-diagram of a mine control system according to the invention.

Figure 1A:
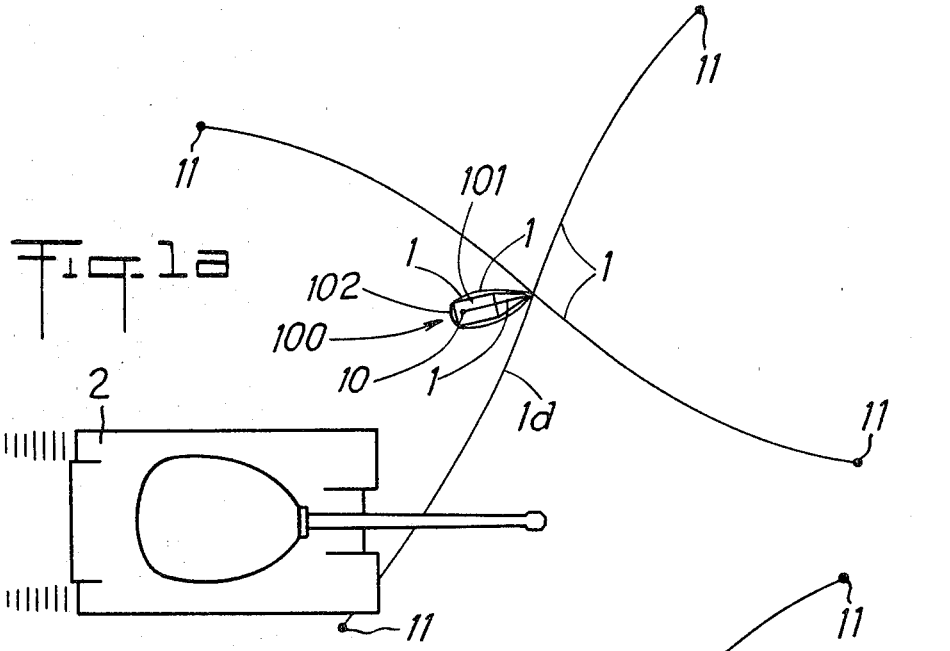
Figure 1B:
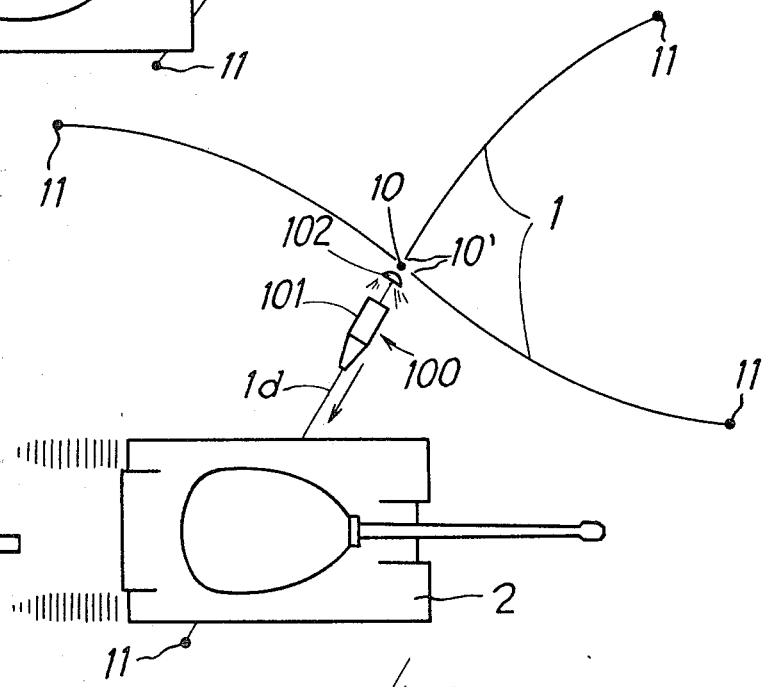
Figure 1C:
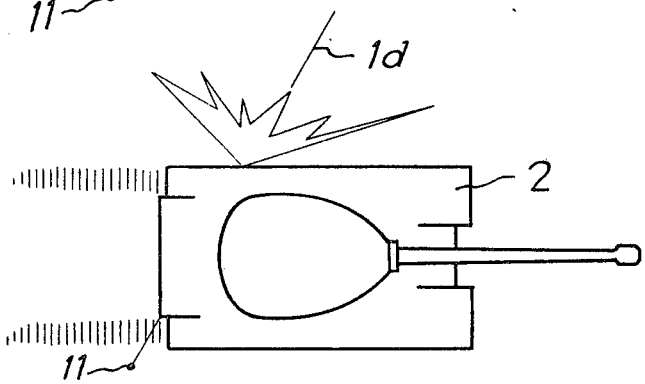

FIGS. 1*a* to 1*c* explicit the principle of the present invention. A mine 100 exhibiting the characteristics which will be recited hereinafter, and provided in particular with propelling means, is placed on the ground in a waiting position (FIG. 1*a*). A plurality of cables 1, for example four cables, are spread on the ground in several different directions according to an arrangement which may be substantially symmetrical. Each cable is connected to a central point 10 adjacent the said mine 100, which may be an anchoring point in the ground or simply a fastening point on the bottom 102 of the mine. Each cable is guided on the mine body 101 and has a second free end 11, set apart from the mine 100, and if need be anchored in the ground. The surface of action of the mine 100 is then defined by the area which is inside the closed line connecting the different free ends 11 of the cables 1. The length of each cable may vary depending on the proposed applications and in particular depending on the mass of the mine. By way of example, the length of a cable 1 can vary between about 10 and 15 m.

As will be explained in more detail hereinafter, each cable 1 comprises means for detecting the presence in its immediate vicinity of a tracked vehicle such as a tank, and when the target or tank 2 happens to pass over one of the cables which becomes the detector cable 1*d* (FIG. 1*a*) a signal is transmitted to the mine body 101 by the detection means incorporated in the cable 1*d*. The control members situated inside the mine 100 cause then the disconnection for example by cutting of the non-detecting cables 1 close to the central point 10, to form an end 10' no longer attached to the mine 100. Under the action of the propelling means incorporated in the mine 100 and set into operation by the said control members, the mine 100 then follows the path of the detector cable 1*d*, serving as guiding cable, until it reaches the target 2 which has been detected by the cable 1*d*. The active cable 1*d* remains stretched between its end 11 anchored in the ground or held back by the target 2, and its central end, for example secured to a disconnectable base 102 of the mine 100 provided to ensure the tension of the cable when the body 101 is propelled from the mine towards the target 2 (FIG. 1*b*).

When the mine body 101 hits the target 2 (FIG. 1*c*), at the level of a track or of a runner, the pyrotechnical charge contained in the mine is ignited, thus causing the immobilization of the target by damaging a track or its suspension.

The mine can either be laid on the ground of the area to be protected or it can be dropped from an aircraft, a missile or a rocket. The main advantages of a mine according to the invention, with its combined network of cables, reside in the considerable increase of its range of action, since the mine becomes operational not only in the actual spot where it has been laid, but also over the whole field of action defined by the network of cables along which the mines can move whenever a target is detected. For the same number of mines, it is thus possible to cover a much wider damage area than with the conventional mines remaining in fixed position throughout not only the igniting but also the firing. In addition, because of their wide range, it is easy to select already existing obstacles when laying the mine, such as holes, or vegetation to hide the mines, and the latter no longer need to be buried into the ground. The mines according to the invention are nevertheless easily produced in droppable form as will be explained with reference to FIGS. 4 to 7.

Figure 2:
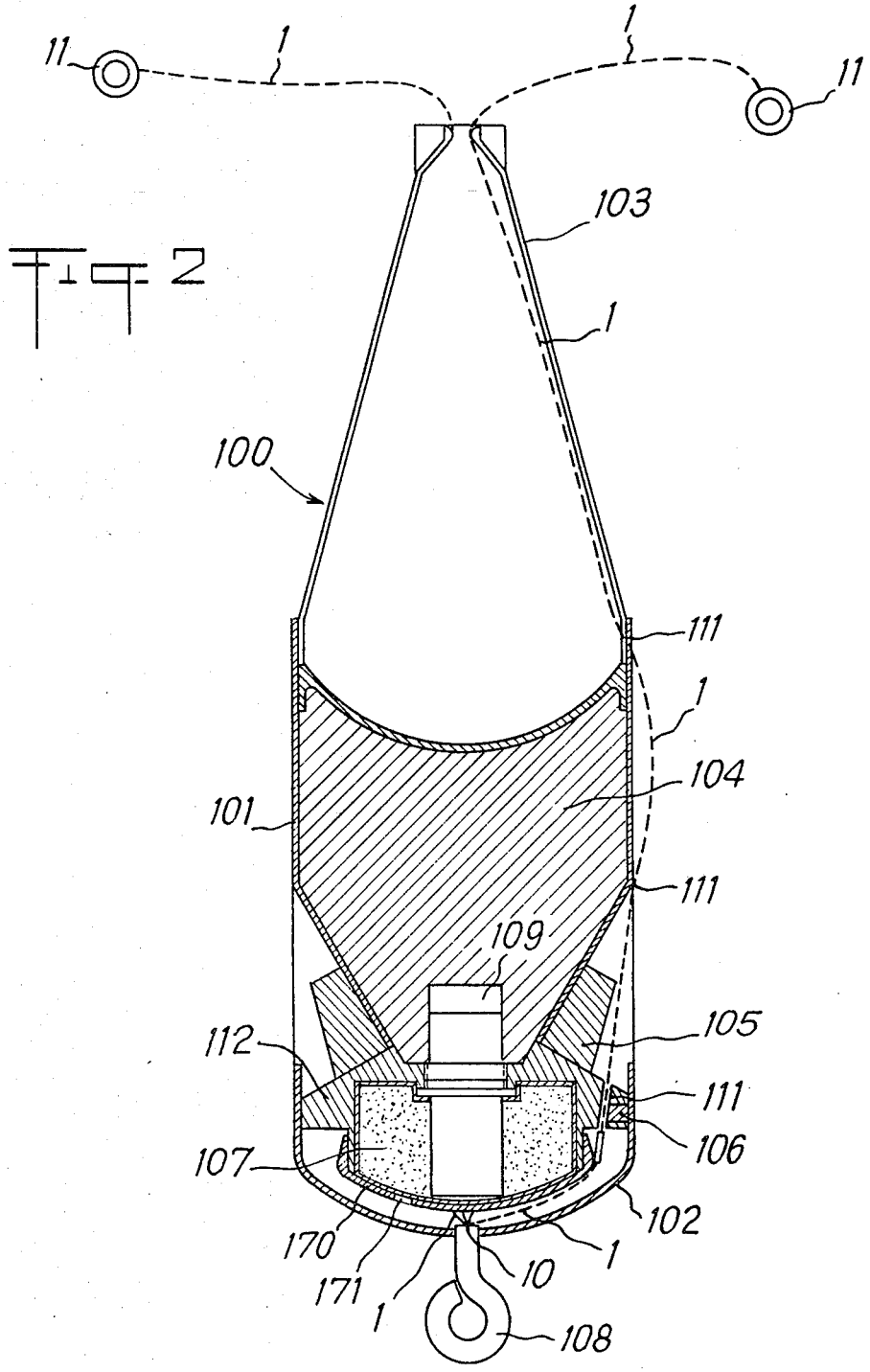
Figure 3:
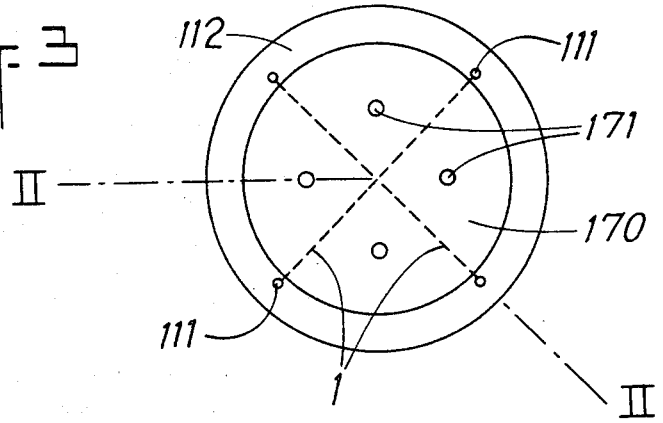
FIG. 3 is a view from beneath of a drop-mine according to the invention, with the base removed.

A first embodiment according to the invention will now be described in reference to FIGS. 2 and 3. The mine 100 of FIG. 2 is essentially designed to be laid manually and can therefore have a specially simplified structure. The mine 100 mainly comprises a mine body 101 incorporating a charge 104, propelling means 107, means 109 for igniting the charge 104, means 111 for guiding the guide-detection cables 1, means 106 for disconnecting or cutting off the cables 1, and electronic circuits 105 controlling the recording of the detection signals received by the cables 1, and controlling the means 106 for cutting off the cable 1 and the starting off of the propelling means 107. A dismountable base 102 can be fixed on the bottom 112 of the body 101 behind the bottom part 170 of the propelling means 107. Said base 102 which is provided with a hook 108 can thus be used for fastening one end 10 of the cables 1, whereas the other free end 11 of the cables 1 is designed to be placed away from the mine 100. The mine body 101 is advantageously extended at its fore end by a casing member 103 which helps the mine 100 to move on the ground along a cable 1 when said mine is being propelled towards the target thus creating an attacking distance between the point of impact and the charge 104.

As already indicated, the cables 1 associated to the mine 100 have a double function since they are used both for detecting a target and for guiding the mine in its movement of approach towards said target, following the detection thereof, and the switching on of the propelling means by the control circuits 105. The cables 1 can be produced in very different ways depending on the applications considered.

Thus, the detection function can be achieved by placing inside the cable, two conducting leads or strips, set apart, and which, under the crushing effect of the track, close up a circuit by coming into contact, or cause a variation of capacity. According to another embodiment, the cables can contain conductors which form part of an electronic detection circuit, the characteristics of which would be perturbed by the passage, very close-to, (i.e. on the cable), of the metallic mass of the vehicle, or which form a circuit of magnetic induction influenced by the said mass. It is also possible to use hollow cables forming a hydraulic or pneumatic capacitance influenced by the crushing of the track. These embodiments are of course non-restrictive and various types of pick-up means can be incorporated in the cables 1.

The mine guiding function can be ensured either by a simple sheath enclosing the detection circuits of the cables 1, or by a cable working independently of the detection member proper although made integral therewith, for example by adhesive means, or by rings, bindings, braiding, etc. to constitute a guide-detection cable 1. Light materials such as materials known under the names of "Kevlar" or "Nylon", or braided metallic cables can be selected, depending on the stresses involved with each application. It is however, necessary for the overall cable to remain flexible and light. The production of a cable from a hollow cylindrical sheath in a material such as kevlar or nylon which incorporates two thin conducting tapes in the shape of two half-shells adhesively fixed inside the sheath and set apart one from the other confers to the said cable the required qualities of lightness and flexibility. A braided-type production is likewise advantageous due to its resiliency which minimizes any shocks resulting from the cable mechanical strain caused by the passage of a target.

The free ends 11 of the cables 1, farthest from the mine 100, can simply rest on the ground without any special fastening since the passage of a tank-track over the active cable will already stretch the latter between the central point 10 and the target 2 (FIG. 1*b*) to constitute an efficient guiding path for a rapid movement of the mine body towards the target. However, the ends 11 of the cables 1 can also be secured to the ground by stop means in order to prevent any sliding.

Electronic circuits 105 for processing the detection signal supplied by a detection cable 1 and for controlling the operation of the mine can be constituted from conventional elements of mine firing circuits. For example, the circuits 105 receive, analyze and record the signals delivered by the detection elements found in each one of the cables 1. Said signals, when they indicate the presence of a target on one of the cables, permit to identify that particular cable as detection cable 1*d* which will serve as a guide for the mine. However, to increase the reliability of the detection, the identification can be subordinated to the simultaneous transmission of a signal by an accessory detector, which is non-directional 301, and is tied to the mine body 101, and which can be for example of the magnetic, infra-red or acoustic type. The identification can also be subordinated to the intensity of the signal delivered by the cable, by means of a threshold circuit, or to the duration of that signal, by means of a timing circuit 351, with a view to differentiate for example the passage of a wheeled vehicle from the passage of a tracked vehicle.

After the identification of a cable 1*d* as detector of the presence of a target by validation of the detection signal delivered by the said cable, the control circuits 105 cause, whenever more than one cable 1 is associated to the mine 100, the disconnection of the other non-active cables which have not delivered a detection signal, and this by actuating the cables separating means 106. Said means 106 can consist for example of small pyrotechnic charges, or of electric fusion means or else electromagnetically controlled cutting members.

The mine propelling device 107 is constituted by a compact driving member which can start virtually instantaneously permitting the rapid displacement of the mine towards the target. In view of the speed and of the length of the vehicles in question, the time needed by the mine to come closer to the target and therefore the characteristics of the propelling device can vary. Said period of time can vary for example between about 0.3 and 1 second.

According to the embodiment illustrated in FIG. 2, the device 107 is constituted by a small jet propeller ignited by control circuits 105 after the identification of a detector cable 1*d*, and if necessary disconnection of the non-active cables. Under the pressure of the said propeller, the mine body 101 starts moving towards the target along the active cable 1*d*, the mine body being slidable thereon due to the guide elements 111. Outlets 171 are provided at the bottom 170 of the propeller 107. As clearly shown in FIG. 3, the outlets 171 are offset with respect to the passage of the cables towards the adjacent guiding orifices 111 of the cutting means 106.

Figure 5:
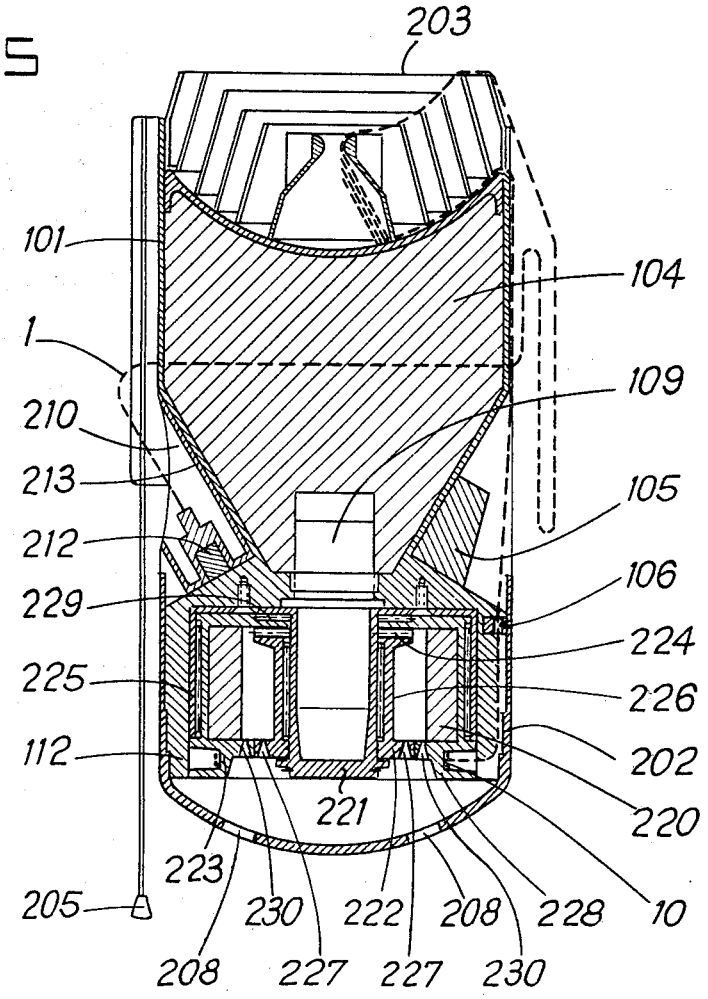
Figure 6:
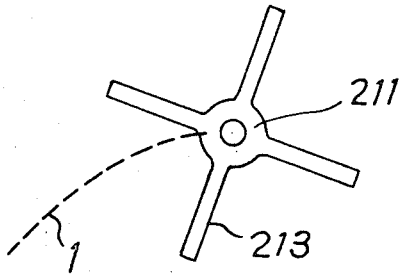
FIG. 6 is a detailed view of a a cable end.

According to another embodiment, illustrated in FIG. 5, with reference to a drop-mine, but applicable also to land mines, the device 107 is constituted by means for winding the active cable 1*d* which is thus swallowed up by the mine body 101 and causes the displacement of the latter towards the target.

The military charge 104 can be for example a flat charge, a high expensive charge, or a hollow-shaped charge. The igniting can be ensured when the vehicle is hit by any known means such as an inertia rocket, a magnetic-drive rocket, an infra-red rocket, or else an electric rocket, or by means of the combination of for example an inertia rocket 341 with a magnetic-drive rocket 342. The igniting means 340 can in addition comprise a delayed action member 344 to guarantee for example that the ignition only takes place after the stabilization of the mine 100.

In the case illustrated in FIG. 2, the base 102 is disconnected from the mine body 101 when the latter starts moving under the action of the propelling device 107, so that the active cable which has not been cut off by the cable disconnecting means 106 remains stretched between the target and the anchoring hook 108.

FIGS. 4 to 7 relate to drop-mines 100 provided with cables 1 similar to those described with reference to FIGS. 1 to 3.

In the case of a mine 100 which is dropped in position, said mine should be equipped with a system for the automatic unfolding of the cables 1 coiled beforehand on the body 101. As can be seen in FIG. 7*a*, a mine 100 comprising a base 102, a body 101 and side reinforcements 210 designed to permit the ejection and subsequent unfolding of the coiled cables 1, is dropped over the area to be protected. A stabilizing system capable if necessary of braking the descent of the mine is provided, for controlling the position of the mine when it touches the ground. Indeed, the automatic unfolding in good conditions of the cables 1, pre-supposes that the mine had a more or less stabilized position in descent, its axis being close to the vertical. The stabilizing system can be constituted by the shape of the mine proper and by its centering, or by aerodynamically unfolding blades. But according to an advantageous embodiment (FIG. 7*b*) the stabilizing system can consist of a parachute 204, a strap-parachute for example. A blade or a parachute system permits to reduce the landing speed (of the order of 50 m/sec. for example), and thus facilitates the ejection of the cables 1 whilst guaranteeing the integrity of the mine. A parachute system 204, of reduced volume and inexpensive, also permits to bring out a casing member 203, initially folded in.

For the cables to unfold automatically and in good conditions, it is preferable for the said unfolding operation to be initialized before the movement of the mine can have been perturbed by the ground (FIG. 7*c*). To do so, a signal should be delivered by the mine when the latter approaches the ground. By way of example, and quite simply, the device provided for detecting the proximity of the ground can be provided with an unfoldable rod 205 fitted with an electrical contact permitting the production of a signal when the lower end of the rod is in contact with the ground, the said signal initializing the cable automatic unfolding system by a circuit 331.

The cable automatic unfolding system can comprise (FIGS. 4 to 6) ejection means such as small ejection explosives 212 capable of propelling out of a housing 210 a fly-weight 211 tied to the free end of the cable 1, which end is to be projected away from the mine body 101. A fly-weight 211 comprises preferably unfoldable wings 213 which, in a folded-up storage position inside the housing, are used to guide the fly-weight 211, and in an ejected position (see FIG. 6) act as a stop means for the cable on the ground to prevent sliding. The angle formed by the walls of the housing 210 and the ejection speed are determined in relation to the range to reach, i.e. in relation to the length of the cables 1 coiled up in the storage position (FIGS. 7*a* and 7*b*). After touching the ground, the mine is in the condition illustrated in FIG. 7*d*, its cables being unfolded.

According to a variant embodiment, the unfolding of the cables could take place after the mine has touched ground, and not when it approaches the ground, and before touching down as shown in FIG. 7*c*. The unfolding of the cables after touch down of the mine however implies the use of means for controlling the position of said mine.

In every case, after the timing effected by a circuit 332 to allow the mine to come to a stop and the cables to settle down, the mine is set that is to say that the detection and propelling systems and the charge igniting system are ready to operate.

Figure 4:
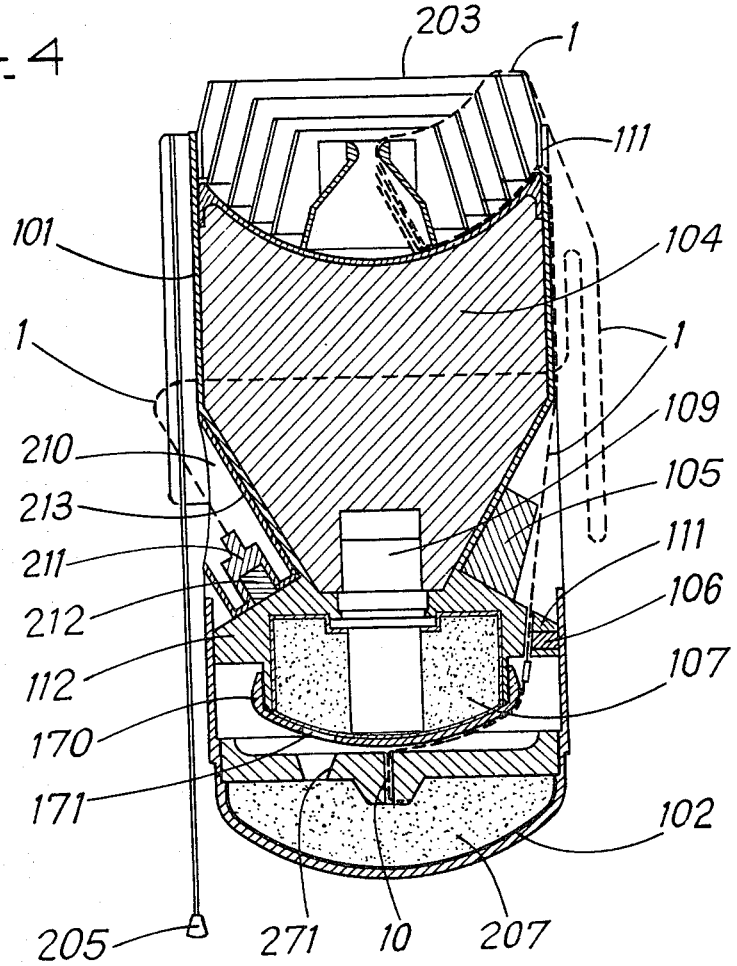
FIGS. 4 and 5 illustrate two axial half-sections relative to two embodiments of a drop-mine according to the invention.

FIGS. 4 and 5 illustrate examples of drop-mines according to the invention which are provided with an unfoldable front casing member 203, in order to minimize the space required by the mine 100 in its conveyance craft. According to the said figures, the unfoldable front casing member 203 can consist of an assembly of segments folded one into the other for storage and positioned by jointing after the mine has been dropped, for example under the pulling action of the parachute 204

(FIG. 7*b*). The casing member is provided with means for locking it in the open position, permitting, on subsequent impact with a target, to transmit the deceleration necessary to the functioning of an inertia rocket such as 341. Other retractable systems of casing can of course be used such as for example a simple cylinder with a rounded front face, which slides over the mine body to give an attacking distance when a target is hit and to help pulling the mine on the ground when said mine is guided along a detector cable 1*d*.

FIG. 4 is concerned with a drop-mine which, as in the case of the land mine of FIG. 2, comprises inside a body 101 a military charge 104, means 109 for igniting the charge 104, a propeller 107, integral with the base 112 of the body 101, electronic control means 105, means 106 for cutting off the non-active cables, and cables 1 connected to a removable cap 102.

But, the mine illustrated in FIG. 4 being a drop-mine, it further comprises a retractable front casing member 203, a rod 205 to detect the proximity of the ground, means for stabilizing the descent of the drop-mine, not shown in FIG. 4, and cable ejecting means 210, 212, which cooperate with cable endpieces 211. Moreover, the releasable base 102 on which are secured the cable ends 10 adjacent the bottom 170, in the detecting position, is provided with a small propeller 207 presenting orifices 271 and acting in reverse to the propeller 107 to eject the cap 102 backwards when the mine body 101 advances towards the target, in order to keep the detector cable, acting as a guide, stretched.

The drop-mine shown in FIG. 5, differs from that shown in FIG. 4 by the system used for propelling the mine towards the target once the latter has been detected, and for cutting off the non-active cables by the disconnecting means 106. The mine shown in FIG. 5 comprises in the base 112 of the body 101 a stationary part forming mandrel 221. A first rotor 222 is mounted via needle bearings 226 on the center part of the mandrel 221. A second rotor 223, coaxial to the first 222, situated on the outside thereof, and provided with a drumlike part 228 for winding up the cables 1 is also mounted via needle bearings 225 in the base 112 of the mine body 101. Axial abutting pins 224 and 229 are also provided, on the one hand, between the rotors 222 and 223 and, on the other hand, between the outer rotor 223 and the base 112 or a fixed part connected thereto. A gas generator 220, controlled by the control circuit 105 is arranged in the annular space existing between the two rotors 222 and 223. Each rotor 222, 223, comprises on its frontal rear face with nozzles 227, 230 respectively, oriented differently in order to permit the rotation of the rotors 222 and 223 in reverse directions under the action of the gas generator 220. The drum 228 of the rotor 223 to which are tied the ends 10 of the cables 1 rotates under the action of the generator 220 in one cable-winding direction so as to "swallow up" the detector cable which has not been cut off by the disconnecting means 106 and thus to pull the mine towards the free end 211 of the cable and towards the detected target. At the same time, the rotation of the first rotor 222 which is also driven by the gas generator 220, permits to minimize the kinetic moment of rotation in order to limit the gyroscopic effects. In this embodiment, the cap 202 which is not releasable since it has no part in stretching the cable pulled by the drum 228, is provided with gas outlets 208. The other elements constituting the mine are similar to those described hereinabove in reference to FIG. 4.

FIG. 8 schematically shows the different elements of one simplified embodiment of the control of the operation of a drop-mine.

A general electric power supply 321 is connected to a first sub-assembly 330 designed to control the positioning of the mine. The sub-assembly 330 comprises a first device 205 for detecting the proximity of the ground, and consisting for example of the said unfoldable rod, which device 205 is itself connected to a circuit 331 controlling the cable automatic unfolding system. Said circuit 331 is in turn connected to a timing circuit 332, already cited hereinbove, which timing circuit 332 then ensures the setting in action of the target detection means 310, of the means 105 controlling the propelling means 107, and of the loading of the igniting means 109 via switching means 322 connected to the general supply 321.

The target detection device 310 comprises detection means incorporated to the different cables 1 and an omnidirectional detector 301 mounted on the mine body. The detection means incorporated to the cables 1 can be constituted for example by simple electrical wires the crushing of which causes the transmission of a signal by short-circuiting. A line 1*d* made detecting by short-circuiting is shown.

The control circuit 105 comprises, as already described, circuits 351 responsive to a signal delivered by the cables 1 and preferably provided with a duration threshold circuit. AND gates 352 comprising an input connected to a duration threshold circuit 351 and another input connected to the omnidirectional detector 301 are provided with an output connected, on the one hand, to cable disconnecting means 106 provided for disconnecting the other cables, whenever a signal is present on the two inputs of the AND gate 352, and on the other hand, to an OR gate 353 the output of which is connected to a time-delay circuit 354 itself controlling on the one hand, the switching on of the propelling means 107 and, on the other hand, the circuit 355 to actuate the detectors 341, 342 associated to the igniting member 109 of the charge 104 inside the firing sub-assembly 340. The detectors 341, 342 can consist for example of the inertial impact detector and of a proximity detector working by magnetic influence. The outputs of the detectors 341, 342 are connected to an AND gate 343 which is in turn connected to a time-delay circuit 344 connected to the igniting member 109 and permitting to cause the firing only after a preset period of time following the hitting of the target.

The circuits shown in FIG. 8 are only shown of course by way of example and could for example be re-grouped within more complex circuits assemblies ensuring supplementary functions when the mine is controlled.

In the same way, the cable winding means described in reference to FIG. 5 could be produced differently for example with gripping devices, with supported gears or runners driven in rotation by a turbine, or the aforedescribed side nozzles fed by the gas generator.

What is claimed is:

1. An antitank mine with a wide area of action, comprising means for detecting a target of the tracked vehicle type and a mine body incorporating a pyrotechnical charge, means for controlling the triggering of the mine in response to a signal given by the said target detection means, means for firing the charge and means for propelling the mine body triggered by the said control means, wherein said mine comprises a plurality of flexible guide-detection cables, each cable being provided with both target detection means to deliver a signal indicating a target and reinforcement means to act as a guide when the mine body moves under the action of the said propelling means, wherein said plurality of guide-detection cables are spreadable in several different directions around the mine body, and said mine further comprises means for selecting an active cable providing a target indicative signal, said selecting means being controlled by the said control means after the delivery of a target indicative signal by one of the cables to disconnect from the mine body all the other cables.

2. Mine as claimed in claim 1, wherein the means for propelling the mine body comprises a small jet-propeller placed inside the mine body.

3. Mine as claimed in claim 2, wherein a disconnectable base with auxiliary propelling means is associated to the mine body, the cable ends closest to the mine body are joined to the said disconnectable base, the mine body is slidable with respect to the cables and the auxiliary means for propelling the disconnectable base and the mine body propelling means are triggered virtually simultaneously after the detection of a target.

4. Mine as claimed in claim 2, wherein the mine body comprises a front casing member of essentially conical or ogival shape and the pyrotechnical charge is situated behind the said casing member.

5. Mine as claimed in claim 1, wherein said mine comprises an automatic unfolding system for the guide-detection cables previously coiled on the mine body, and said unfolding system comprises fly-weights attached to the free ends of the cables to be projected away from the mine body, and means for ejecting the fly-weights away from the mine body when the mine is laid.

6. Anti-tank mine designed to be dropped to the ground from an aircraft, missile or rocket, such as claimed in claim 5, wherein said mine comprises a system for stabilizing it in the vertical position and for slowing down the dropping speed of the mine if necessary.

7. Drop-mine as claimed in claim 6, wherein said mine comprises means for detecting the proximity of the ground, in which case the system ensuring the automatic unfolding of the guide-detection cables is controlled by the said means for detecting the proximity of the ground.

8. Drop-mine as claimed in claim 6, wherein an unfoldable front casing member the unfolding of which is controlled by the mine body stabilizing system.

9. Mine as claimed in claim 1, wherein the means for controlling the triggering of the mine comprise a supplementary detector, which is non-directional and is connected to the mine body.

10. An antitank mine with a wide area of action, comprising means for detecting a target of the tracked-vehicle type and a mine body incorporating a pyrotechnical charge, means for controlling the triggering of the mine in response to a signal given by the said target detection means, means for firing the charge and means for propelling the mine body triggered by the said control means, wherein said mine comprises at least one flexible guide-detection cable provided with both target detection means to deliver a signal indicating a target and reinforcement means to act as a guide when the mine body moves under the action of the said propelling means, wherein said mine comprises means for winding up the guide-detection cable incorporated in the mine body, means for driving the cable winding means in rotation, and wherein said propelling means comprises a gas generator for supplying said driving means, whereby said mine body starts moving under the action of the control means after the detection of a target, so as to drive the mine body towards a free end of said guide-detection cable.

11. Mine as claimed in claim 10, wherein the said means for driving the cable winding means in rotation comprises first and second co-axial rotors driven by the gas generator in two opposite directions of rotation, and wherein one of said rotors is a drum for receiving the cable to be wound up.

* * * * *